United States Patent [19]

Hinojos et al.

[11] Patent Number: 4,617,110

[45] Date of Patent: Oct. 14, 1986

[54] CONTROL OF A HYDROFINING PROCESS FOR HYDROCARBON-CONTAINING FEED STREAMS WHICH PROCESS EMPLOYS A HYDRODEMETALLIZATION REACTOR IN SERIES WITH A HYDRODESULFURIZATION REACTOR

[75] Inventors: Antonio R. Hinojos; Bertram T. Bone, Jr., both of Bartlesville, Okla.

[73] Assignee: Phillips Petroleum Company, Bartlesville, Okla.

[21] Appl. No.: 619,253

[22] Filed: Jun. 11, 1984

[51] Int. Cl.[4] ..... C10G 45/02

[52] U.S. Cl. ..... 208/211; 208/213; 208/251 H; 208/DIG. 1; 422/62; 422/111; 422/112; 585/259; 585/263

[58] Field of Search ..... 422/62, 110–112; 208/213, 251 H, DIG. 1, 211; 364/500, 557; 585/259, 263; 260/699, 700

[56] References Cited

U.S. PATENT DOCUMENTS

| | | | |
|---|---|---|---|
| 2,519,481 | 8/1950 | Kubie et al. | 260/700 |
| 2,771,493 | 11/1956 | Jacks et al. | 260/700 |
| 3,839,483 | 10/1974 | Carr et al. | 585/259 |
| 3,936,371 | 2/1976 | Ueda et al. | 208/251 H |
| 4,016,067 | 4/1977 | Flecher et al. | 208/89 |
| 4,054,508 | 10/1977 | Milstein et al. | 208/89 |
| 4,188,284 | 2/1980 | Quick et al. | 208/216 PP |
| 4,212,729 | 7/1980 | Hensley, Jr. et al. | 208/210 |
| 4,231,753 | 11/1980 | Stewart | 208/DIG. 1 |
| 4,235,703 | 11/1980 | Kegier et al. | 208/89 |
| 4,236,219 | 11/1980 | Killebrew, Jr. et al. | 422/62 |
| 4,241,230 | 12/1980 | Drinkard | 585/259 |
| 4,318,178 | 3/1982 | Stewart et al. | 422/62 |
| 4,367,354 | 1/1983 | Dibiano | 422/62 |
| 4,476,094 | 10/1984 | Carson | 422/112 |
| 4,536,606 | 8/1985 | Hobbs | 364/500 |

FOREIGN PATENT DOCUMENTS

| | | | |
|---|---|---|---|
| 354880 | 3/1972 | U.S.S.R. | 422/110 |
| 717025 | 2/1980 | U.S.S.R. | 208/DIG. 1 |
| 981306 | 12/1982 | U.S.S.R. | 585/263 |

*Primary Examiner*—David L. Lacey

*Attorney, Agent, or Firm*—French and Doescher

[57] ABSTRACT

In a two-stage hydrofining process, hydrogen is utilized as a quench fluid to reduce the temperature of the effluent withdrawn from the hydrodemetallization stage prior to providing such effluent to the hydrodesulfurization stage and the flow of such hydrogen is controlled so as to maintain a desired temperature for the feed to the hydrodesulfurization stage. Also, the flow of fuel to a furnace is controlled so as to maintain a desired temperature for the feed to the hydrodemetallization stage and hydrogen flow rates are manipulated throughout the process so as to maintain desired hydrogen concentrations throughout the hydrofining process.

29 Claims, 1 Drawing Figure

Figure 1:
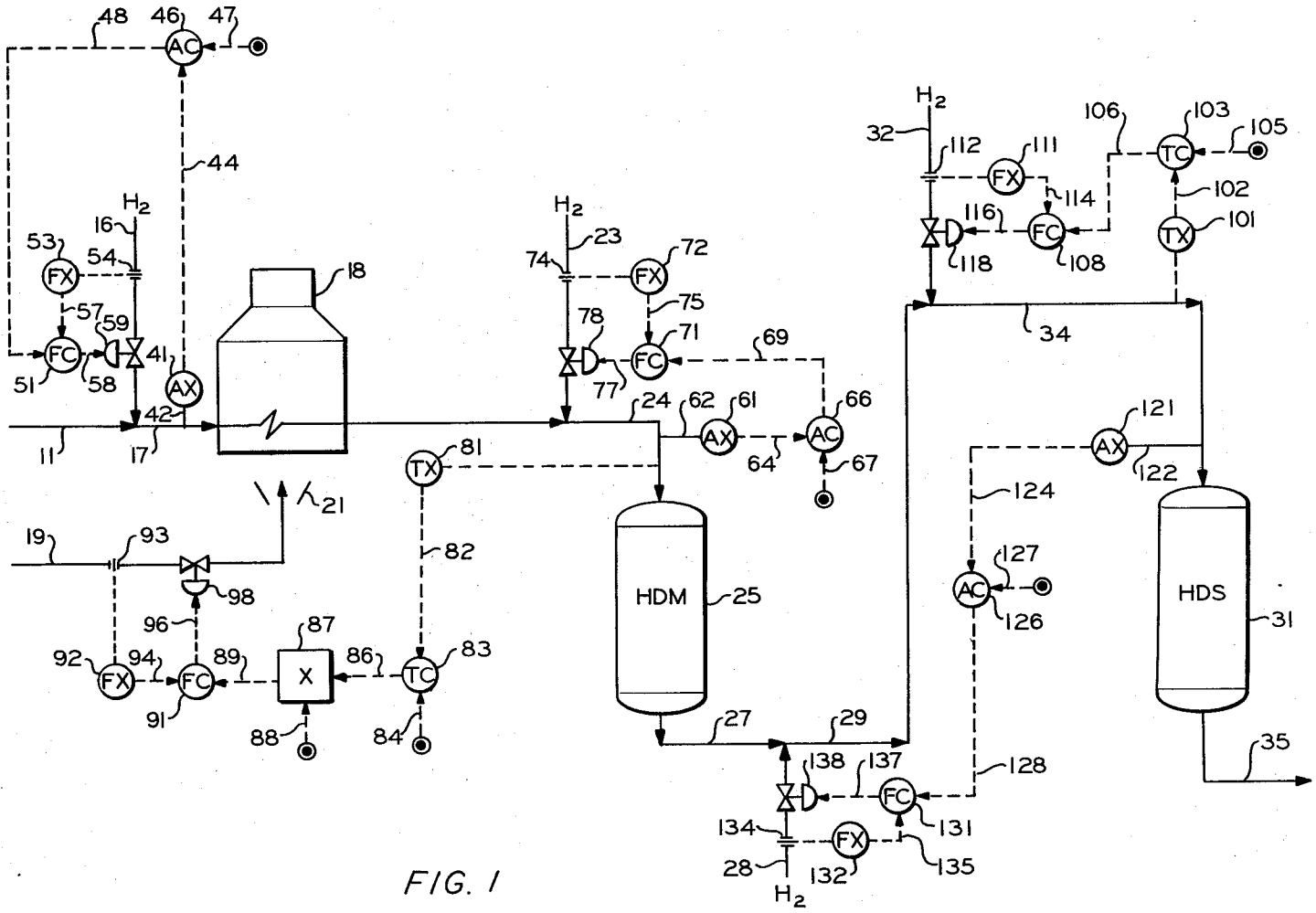

CONTROL OF A HYDROFINING PROCESS FOR HYDROCARBON-CONTAINING FEED STREAMS WHICH PROCESS EMPLOYS A HYDRODEMETALLIZATION REACTOR IN SERIES WITH A HYDRODESULFURIZATION REACTOR

This invention relates to a hydrofining process for hydrocarbon-containing feed streams. In one aspect, this invention relates to method and apparatus for maintaining a desired temperature for the feed to a second reactor in a hydrofining process which employs first and second reactors in series. In still another aspect, this invention relates to method and apparatus for maintaining a desired temperature for the feed to the first reactor in a hydrofining process which employs first and second reactors in series. In still another aspect, this invention relates to method and apparatus for maintaining a desired hydrogen concentration for a hydrofining process which employs first and second reactors in series.

It is well known that crude oil, crude oil fractions and extracts of heavy crude oils, as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalyst employed in processes such as catalytic cracking, hydrocracking, hydrogenation or hydrodesulfurization.

The presence of other components such as sulfur and nitrogen is also considered detrimental to the processability of a hydrocarbon-containing feed stream and also the presence of such components in products may violate environmental standards. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur, nitrogen and components which have a tendency to produce coke.

Processes in which the above-described removals are accomplished are generally referred to as hydrofining processes (one or all of the above-described removals may be accomplished in a hydrofining process depending on the components contained in the hydrocarbon-containing feed stream).

In some hydrofining processes, the removal of metals and components such as sulfur, nitrogen, and Ramsbottom carbon residue is accomplished in a single reactor. However, as has been previously stated, metals in particular tend to contaminate and deactivate catalysts which are particularly effective for hydrodesulfurization. Thus, two-stage processes are often used for hydrofining.

In such two-stage hydrofining processes, the first stage is predominantly utilized for demetallization. Other undesirable components may be removed in the first stage but the catalyst is generally a cheap catalyst ("demetallization catalyst") such as unpromoted alumina which will primarily remove some metals from the feed. The effluent from the first reactor is then provided to a second reactor which generally contains a promoted catalyst such as cobalt, nickel and molybdenum on alumina. Some metals will remain in the feed to the second-stage reactor but, in general, the concentration of metals will have been significantly reduced which reduces contamination of the catalyst in the second stage which is generally referred to as a hydrodesulfurization catalyst. Since the hydrodesulfurization catalyst of the second stage is usually considerably more expensive than the demetallization catalyst of the first stage, such reduced contamination is extremely important from an economic standpoint and also provides for a reduced concentration of sulfur and other undesired components in the effluent withdrawn from the second-stage reactor with respect to that which can generally be obtained using only a single stage.

Initially, the hydrodesulfurization catalyst will generally be active at lower temperatures than the hydrodemetallization catalyst. Thus, it is desirable to reduce the temperature of the effluent withdrawn from the first-stage reactor prior to providing such effluent as a feed to the second-stage reactor. Also, it is desirable to control the temperature of the feed provided to the first stage reactor and to maintain desired hydrogen concentrations throughout the two-stage hydrofining process.

It is thus an object of this invention to provide method and apparatus for cooling the effluent withdrawn from the first-stage reactor prior to providing such effluent as a feed to the second-stage reactor in a two-stage hydrofining process. It is also an object of this invention to provide method and apparatus for controlling the temperature of the feed provided to the first stage reactor and also for controlling the hydrogen concentration throughout a two-stage hydrofining process.

In accordance with the present invention, method and apparatus is provided whereby hydrogen is utilized as a quench fluid to reduce the temperature of the effluent withdrawn from the hydrodemetallization stage of a two-stage hydrofining process prior to providing such effluent to the hydrodesulfurization stage. Use of hydrogen benefits the reaction in the hydrodesulfurization stage and also reduces the expense of cooling the effluent from the hydrodemetallization stage with respect to using a heat exchanger.

Also in accordance with the present invention, method and apparatus is provided for controlling the flow of fuel to a furnace utilized to heat the feed provided to the demetallization stage so as to maintain a desired temperature for such feed. Also, hydrogen flow rates are manipulated throughout the hydrofining process so as to maintain desired hydrogen concentrations throughout the hydrofining process. Such control is beneficial in substantially maximizing the removal of undesired components from the feed and also in substantially minimizing the cost of the hydrofining process.

Other objects and advantages of the invention will be apparent from the foregoing brief description of the invention and the claims as well as the detailed description of the drawing which is briefly described as follows:

FIG. 1 is a diagrammatic illustration of a two-stage hydrofining process and the associated control system of the present invention.

The invention is described both briefly and in detail in terms of a two reactor system. However, the invention is applicable to the use of more than two reactors in series if desired.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a hydrocarbon-containing feed stream which also contains metals and sulfur flows through conduit means 11. Any suitable hydrocarbon-containing feed stream may be provided through conduit means 11 to the hydrofining process illustrated in FIG. 1. Suitable hydrocarbon-containing feed streams include petroleum products, coal, pyrolyzates, products from extraction and/or liquefaction of coal and lignite, products from tar sands, products from shale oil, supercritical extracts of heavy crudes and similar products. Suitable hydrocarbon feed streams include gas oil having a boiling range from about 205° C. to about 538° C., topped crude having a boiling range in excess of about 343° C. and residuum. However, hydrofining processes such as illustrated in FIG. 1 are particularly directed to heavy feed streams such as heavy topped crudes, extracts of heavy crudes, residuum and other materials which are generally regarded as too heavy to be distilled. These materials will generally contain the highest concentrations of undesirable components such as metals and sulfur.

The hydrocarbon-containing feed stream flowing through conduit means 11 is combined with hydrogen flowing through conduit means 16 and the combined fluid stream is provided through conduit means 17 to the furnace 18. The hydrogen flowing through conduit means 16 is utilized to reduce the formation of coke in the furnace 18.

A fuel is provided through conduit means 19 to the burner 21 associated with the furnace 18. The heat provided by the combustion of the fuel flowing through conduit means 19 at the burner 21 is utilized to provide heat to the fluid flowing through conduit means 17.

After passing through the furnace 18, the fluid flowing through conduit means 17 is combined with hydrogen flowing through conduit means 23. The resulting combination is provided through conduit means 24 as the feed to the hydrodemetallization reactor 25. Hydrogen flowing through conduit means 23 is considered make-up hydrogen and is utilized to insure that sufficient hydrogen is available for the hydrodemetallization reactor.

The effluent from the hydrodemetallization reactor 25 is withdrawn through conduit means 27. This effluent is combined with hydrogen flowing through conduit means 28 to form the fluid stream flowing through conduit means 29. Hydrogen flowing through conduit means 28 is make-up hydrogen which is utilized to insure that sufficient hydrogen is available for the hydrodesulfurization reactor 31.

The hydrogen stream flowing through conduit means 32 is combined with the fluid stream flowing through conduit means 29 to form the fluid stream which flows through conduit means 34. The fluid stream flowing through conduit means 34 is provided as the feed stream to the hydrodesulfurization reactor 31. The hydrogen flowing through conduit means 32 is considered quench hydrogen and is utilized to control the temperature of the feed flowing through conduit means 34 and to also provide hydrogen for the hydrodesulfurization reactor 31.

The effluent from the hydrodesulfurization reactor 31 is withdrawn through conduit means 35.

Any suitable hydrodemetallization catalyst may be utilized in the hydrodemetallization reactor 25. Generally, a refractory inorganic material is utilized and alumina is a particularly preferred material. In any event, the demetallization catalyst used in the hydrometallization reactor 25 will typically be cheaper than the hydrodesulfurization catalyst used in the hydrodesulfurization reactor 31 and will require that the feed temperature for the hydrodemetallization reactor 25 be higher than the feed temperature for the hydrodesulfurization reactor 31.

Any suitable hydrodesulfurization catalyst may be used in the hydrodesulfurization reactor 31. Generally, the hydrodesulfurization catalyst will comprise a support and a promoter. Common supports are alumina, silica and silica alumina. Common promoters are metal selected from the group consisting of the metals of Group VIB, Group VIIB and Group VIII of the Periodic Table. Cobalt and molybdenum are particularly preferred promoters. Again it is noted that the hydrodesulfurization catalyst will generally be more expensive than the hydrodemetallization catalyst and will have a higher activity which permits a lower feed temperature.

Analyzer transducer 41 is in fluid communication with the fluid flowing through conduit means 17 through conduit means 42. The analyzer transducer 41 provides an output signal 44 which is representative of the actual concentration of free hydrogen in the fluid flowing through conduit means 17. The analyzer transducer 41 and the other analyzer transducers which will be described hereinafter may be a Model 102 Chromatographic Analyzer manufactured by Applied Automation, Inc., Bartlesville, Okla.

Signal 44 is provided from the analyzer transducer 41 as the process variable input to the analyzer controller 46. The analyzer controller 46 is also provided with a set point signal 47 representative of the concentration of free hydrogen in the fluid flowing through conduit means 17 desired to reduce coking in the furnace 18.

In response to signals 44 and 47, the analysis controller provides an output signal 48 which is responsive to the difference between signals 44 and 47. Signal 48 is scaled so as to be representative of the flow rate of hydrogen through conduit means 16 required to maintain the desired hydrogen concentration represented by signal 47. Signal 48 is provided from the analysis controller 46 as the set point input to the flow controller 51.

It is noted that, if desired, the set point signal 48 may be set by a process operator without the benefit of an analysis. How much hydrogen should be provided through conduit means 16 will generally be known. Based on this knowledge, signal 48 may be set at this value. A typical value is about 300 standard cubic feet per barrel of the hydrocarbon-containing feed stream flowing through conduit means 11.

Flow transducer 53 in combination with the flow sensor 54, which is operably located in conduit means 16, provides an output signal 57 which is representative of the actual flow rate of hydrogen through conduit means 16. Signal 57 is provided from the flow transducer 53 as the process variable input to the flow controller 51.

In response to signals 48 and 57, the flow controller 51 provides an output signal 58 which is responsive to the difference between signals 48 an 57. Signal 58 is scaled so as to be representative of the position of the control valve 59, which is operably located in conduit means 16, required to maintain the actual flow rate of hydrogen through conduit means 16 substantially equal to the desired flow rate represented by signal 48. Signal 58 is provided as a control signal from the flow controller 51 to the control valve 59 and the control valve 59 is manipulated in response thereto.

Analyzer transducer 61 is in fluid communication with the fluid flowing through conduit means 24 through conduit means 62. Analyzer transducer 61 provides an output signal 64 which is representative of the actual concentration of free hydrogen in the fluid flowing through conduit means 24. Signal 64 is provided from the analyzer transducer 61 as the process variable input to the analysis controller 66.

The analysis controller 66 is also provided with a set point signal 67 which is representative of the concentration of free hydrogen in the feed flowing through conduit means 24 required by the reaction taking place in the hydrodemetallization reactor 25. The value for signal 67 will be known for any particular process based on the catalyst and operating conditions utilized for the hydrodemetallization reactor.

In response to signals 64 and 67, the analysis controller 66 provides an output signal 69 which is responsive to the difference between signals 64 and 67. Signal 69 is scaled so as to be representative of the flow rate of hydrogen through conduit means 23 required to maintain the desired concentration of hydrogen in the fluid flowing through conduit means 24 represented by signal 67. Signal 69 is provided for the analysis controller 66 as the set point signal to the flow controller 71.

As was the case for signal 48, signal 69 may be set by a process operator without the benefit of analysis. Generally, the required average flow rate of hydrogen through conduit means 23 will be known and the set point signal 69 may be set by an operator at this average value plus some margin. This may result in excess hydrogen which is economically undesirable but does avoid the expense of analyzers.

Flow transducer 72 in combination with the flow sensor 74, which is operably located in conduit means 23, provides an output signal 75 which is representative of the actual flow rate of hydrogen through conduit means 23. Signal 75 is provided from the flow transducer 72 as the process variable input to the flow controller 71.

In response to signals 69 and 75, the flow controller 71 provides an output signal 77 which is responsive to the difference between signals 69 and 75. Signal 77 is scaled so as to be representative of the position of the control valve 78, which is operably located in conduit means 23, required to maintain the actual flow rate of hydrogen through conduit means 23 substantially equal to the desired flow rate represented by signal 69. Signal 77 is provided as a control signal from the flow controller 71 to the control valve 78 and the control valve 78 is manipulated in response thereto.

Temperature transducer 81 in combination with a temperature sensing device such as a thermocouple, which is operably located in conduit means 24, provides an output signal 82 which is representative of the actual temperature of the feed flowing to the hydrodemetallization reactor 25. Signal 82 is provided as the process variable input to the temperature controller 83.

The temperature controller 83 is also provided with a set point signal 84 which is representative of the desired temperature of the feed flowing to the hydrodemetallization reactor 25. Signal 84 will be known based on the catalyst, operating conditions and particular feed being processed.

It is noted that, as the catalyst in the hydrodemetallization reactor 25 is deactivated by use, it is generally desirable to increase the temperature of the feed provided to the hydrodemetallization reactor 25. This is accomplished by changing the magnitude of signal 84 during the life of the catalyst so as to increase the temperature as desired to maintain a desired level of metals removal.

In response to signals 82 and 84, the temperature controller 83 provides an output signal 86 which is scaled so as to be representative of the number of BTU's per hour which must be provided to the furnace 18 in order to maintain the actual temperature of the feed provided to the hydrodemetallization reactor 25 substantially equal to the desired temperature represented by signal 84. Signal 86 is provided from the temperature controller 83 as a first input to the multiplying block 87.

The multiplying block 87 is also provided with signal 88 which is representative of the amount of the fuel flowing through conduit means 19 which must be combusted to produce one BTU of heat. This value will be known for most fuels or may be determined by analysis if the composition of the fuel flowing through conduit means 19 varies substantially.

Signal 88 is multiplied by signal 86 to establish signal 89 which is representative of the flow rate of fuel through conduit means 19 required to provide the heat to the furnace 18 represented by signal 86. Signal 89 is provided as the set point input to the flow controller 91.

Flow transducer 92 in combination with the flow sensor 93, which is operably located in conduit means 19, provides an output signal 94 which is representative of the actual flow rate of fuel through conduit means 19. Signal 94 is provided as the process variable input to the flow controller 91.

In response to signals 89 and 94, the flow controller 91 provides an output signal 96 which is responsive to the difference between signals 89 and 94. Signal 96 is scaled so as to be representative of the position of the control valve 98, which is operably located in conduit means 19, required to maintain the actual flow rate of the fuel through conduit means 19 substantially equal to the desired flow rate represented by signal 89. Signal 96 is provided as a control signal from the flow controller 91 to the control valve 98 and the control valve 98 is manipulated in response thereto.

Temperature transducer 101 in conjunction with a temperature sensing device such as a thermocouple, which is operably located in conduit means 34, provides an output signal 102 which is representative of the actual temperature of the feed flowing to the hydrodesulfurizatioin reactor 31. Signal 102 is provided as a process variable input to the temperature controller 103.

The temperature controller 103 is also provided with a set point signal 105 which is representative of the desired temperature of the feed provided to the hydrodesulfurization reactor 31. As was the case with set point signal 84, the magnitude of signal 105 will be known based on process conditions. Also, it will be desirable to increase the magnitude of the temperature represented by signal 105 as the activity of the catalyst in the hydrodesulfurization reactor 31 decreases with use so as to maintain a desired level of removal of undesirable components such as sulfur.

In response to signals 102 and 105, the temperature controller 103 provides an output signal 106 which is responsive to the difference between signals 102 and 105. Signal 106 is scaled so as to be representative of the flow rate of the quench hydrogen through conduit means 32 required to maintain the actual temperature of the feed to the hydrodesulfurization reactor 31 substantially equal to the desired temperature represented by signal 105. Signal 106 is provided from the temperature controller 103 as the set point input to the flow controller 108.

Flow transducer 111 in combination with the flow sensor 112, is operably located in conduit means 32, provides an output signal 114 which is representative of the actual flow rate of hydrogen through conduit means 32. Signal 114 is provided from the flow transducer 111 as the process variable input to the flow controller 108.

In response to signals 106 and 114, the flow controller 108 provides an output signal 116 which is responsive to the difference between signals 106 and 114. Signal 116 is scaled so as to be representative of the position of the control valve 118, which is operably located in conduit means 32, required to maintain the actual flow rate of the quench hydrogen through conduit means 32 substantially equal to the desired flow rate represented by signal 106. Signal 116 is provided as a control signal from the flow controller 108 to the control valve 118 and the control valve 118 is manipulated in response thereto.

The use of hydrogen to cool the feed to the hydrodesulfurization reactor 31 is a particularly advantageous feature of the present invention. The hydrogen is beneficial to the reaction in the hydrodesulfurization reactor 31. Also, use of the hydrogen avoids the expense of a heat exchange which would have to be constructed out of special materials and also avoids the pressure drop across a heat exchanger.

Analyzer transducer 121 is in fluid communication with the fluid flowing through conduit means 34 through conduit means 122. The analyzer transducer 121 provides an output signal 124 which is representative of the concentration of hydrogen in the feed to the hydrodesulfurization reactor 31. Signal 124 is provided from the analyzer transducer 121 as the process variable input to the analyzer controller 126.

The analyzer controller 126 is also provided with a set point signal 127 which is representative of the desired concentration of hydrogen in the feed to the hydrodesulfurization reactor 31. Again, as with set point signal 67, the magnitude of signal 127 will be known by the process operator.

In response to signals 124 and 127, the analysis controller 126 provides an output signal 128 which is responsive to the difference between signals 124 and 127. Signal 128 is scaled so as to be representative of the flow rate of hydrogen through conduit means 28 required to maintain the desired concentration of hydrogen represented by signal 127. Signal 128 is provided from the analysis controller 126 as the set point input to the flow controller 131.

As was the case with signal 69, signal 128 may be set by a process operator without the benefit of analysis. Again, this may result in excess hydrogen especially in view of the use of the quench hydrogen flowing through conduit means 32. However, again, the expense of an analyzer is avoided.

Flow transducer 132 in combination with the flow sensor 134, which is operably located in conduit means 28, provides an output signal 135 which is representative of the actual flow rate of hydrogen through conduit means 28. Signal 135 is provided from the flow transducer 132 as the process variable input to the flow controller 131.

In response to signals 128 and 135, the flow controller 131 provides an output signal 137 which is responsive to the difference between signals 128 and 135. Signal 137 is scaled so as to be representative of the position of the control valve 138, which is operably located in conduit means 28, required to maintain the actual flow rate of hydrogen through conduit means 28 substantially equal to the desired flow rate represented by signal 128. Signal 137 is provided as a control signal from the flow controller 131 to the control valve 138 and the control valve 138 is manipulated in response thereto.

The temperature of the quench hydrogen flowing through conduit means 32 will generally be lower than the temperature of the remaining hydrogen streams. As an example, the temperature of the quench hydrogen flowing through conduit means 32 may be about 150° F. while the temperature of the remaining hydrogen streams may be about 200° F.

In summary with respect to the hydrofining process illustrated in FIG. 1, quench hydrogen is utilized to maintain a desired temperature for the feed provided to the hydrodesulfurization reactor. This is a particularly desired feature of the present invention.

Also, a desired temperature for the feed to the demetallization reactor is maintained and desired hydrogen concentrations are maintained throughout the hydrofining process. This cooling of the feed to the hydrodesulfurization reactor with a hydrogen quench stream and the control of the hydrofining process so as to maintain desired temperatures and hydrogen concentrations results in substantially maximum removal of undesired components and also substantially minimizes the cost of the hydrofining process.

The invention has been described in terms of a preferred embodiment as illustrated in FIG. 1. Specific components used in the practice of the invention as illustrated in FIG. 1 such as flow sensors 54, 74, 93, 112 and 134; flow transducers 53, 72, 92, 111 and 132; analysis controllers 66, 46 and 126; temperature transducers 81 and 101; temperature controllers 83 and 103; and control valves 59, 78, 98, 118 and 138 are each well known, commercially available control components such as described at length in Perry's *Chemical Engineer's Handbook*, 4th Edition, Chapter 22, McGraw-Hill.

The multiplying block 87 may be implemented by a conventional analog multiplier. However, if the control system is implemented on a digital computer such as the Optrol 7000 Process Computer System, manufactured by Applied Automation, Inc., Bartlesville, Okla., then the multiplier 87 may be implemented by software. Also, if a digital computer is available, many of the controller functions illustrated in FIG. 1 may be implemented on the computer.

For reasons of brevity, conventional auxiliary hydrofining process equipment such as pumps and additional measurement-control devices have not been included in the above description as they play no part in the explanation of the invention.

While the invention has been described in terms of the presently preferred embodiment, reasonable variations and modifications are possible by those skilled in the art. Such variations and modifications are within the scope of the described invention and the appended claims.

That which is claimed is:

1. Apparatus comprising:

a hydrodemetallization reactor;

means for providing a hydrocarbon-containing feed stream which also contains metals, sulfur and free hydrogen to said hydrodemetallization reactor;

a hydrodesulfurization reactor;

means for withdrawing the reaction effluent from said hydrodemetallization reactor;

means for combining a quench hydrogen stream with the effluent withdrawn from said hydrodemetallization reactor;

means for providing the effluent withdrawn from said hydrodemetallization reactor combined with said quench hydrogen stream as a feed to said hydrodesulfurization reactor;

means for establishing a first signal representative of the actual temperature of the feed provided to said hydrodesulfurization reactor;

means for establishing a second signal representative of the desired temperature of the feed provided to said hydrodesulfurization reactor;

means for comparing said first signal and said second signal and for establishing a third signal which is responsive to the difference between said first signal and said second signal and scaling said third signal so as to be representative of the flow rate of said quench hydrogen required to maintain the actual temperature of the feed provided to said hydrodesulfurization reactor substantially equal to the desired temperature represented by said second signal; and means for manipulating the flow rate of said quench hydrogen stream in response to said third signal so as to manipulate the rate at which said quench hydrogen stream is combined with the effluent withdrawn from said hydrodemetallization reactor and to maintain the actual temperature for the feed provided to said hydrodesulfurization reactor substantially equal to the desired temperature represented by said second signal.

2. Apparatus in accordance with claim 1 wherein said means for manipulating the flow rate of said quench hydrogen stream in response to said third signal comprises:

a control valve operably located so as to control the flow rate of said quench hydrogen stream;

means for establishing a fourth signal representative of the actual flow rate of said quench hydrogen stream;

means for comparing said third signal and said fourth signal and for establishing a fifth signal which is responsive to the difference between said third signal and said fourth signal and scaling said fifth signal so as to be representative of the position of said control valve required to maintain the actual flow rate of said quench hydrogen stream substantially equal to the desired flow rate represented by said third signal; and means for manipulating said control valve in response to said fifth signal.

3. Apparatus in accordance with claim 1 additionally comprising:

a furnace having an associated burner;

means for passing said hydrocarbon-containing feed stream through said furnace before said hydrocarbon-containing feed stream is provided in said hydrodemetallization reactor;

means for providing fuel to said burner, wherein the combustion of said fuel supplies heat to said hydrocarbon-containing feed stream flowing through said furnace; and means for manipulating the flow of fuel to said burner so as to maintain a desired temperature for the feed provided to said hydrodemetallization reactor.

4. Apparatus in accordance with claim 3 wherein said means for manipulating the flow of fuel to said burner comprises:

means for establishing a fourth signal representative of the actual temperature of the feed supplied to said hydrodemetallization reactor;

means for establishing a fifth signal representative of the desired temperature of the feed supplied to said hydrodemetallization reactor;

means for comparing said fourth signal and said fifth signal and for establishing a sixth signal which is responsive to the difference between said fourth signal and said fifth signal, wherein said sixth signal is representative of the heat per unit time which must be provided to said furnace by the combustion of said fuel in order to maintain the actual temperature of the feed provided to said hydrodemetallization reactor substantially equal to the desired temperature represented by said second signal; and means for manipulating the flow of fuel to said burner in response to said sixth signal.

5. Apparatus in accordance with claim 4 wherein said means for manipulating the flow of said fuel to said burner in response to said sixth signal comprises:

a control valve operably located so as to control the flow rate of said fuel;

means for establishing a seventh signal which is representative of the amount of said fuel which must be combusted in order to supply 1 BTU of heat to said furnace;

means for multiplying said sixth signal and said seventh signal to establish an eighth signal which is representative of the flow rate of said fuel required to supply the heat represented by said sixth signal to said furnace;

means for establishing a ninth signal representative of the actual flow rate of said fuel;

means for comparing said eighth signal and said ninth signal and for establishing a tenth signal which is responsive to the difference between said eighth signal and said ninth signal and scaling said tenth signal so as to be representative of the position of said control valve required to maintain the actual flow rate of said fuel substantially equal to the desired flow rate represented by said eighth signal; and means for manipulating said control valve in response to said tenth signal.

6. Apparatus in accordance with claim 3 additionally comprising:

means for combining a first make-up hydrogen stream with the feed stream provided to said hydrodemetallization reactor after said feed stream is passed through said furnace; and means for manipulating the flow rate of said first make-up hydrogen stream so as to maintain a desired free hydrogen concentration in the feed provided to said hydrodemetallization reactor.

7. Apparatus in accordance with claim 6 wherein said means for manipulating the flow rate of said first make-up hydrogen stream comprises:

a control valve operably located so as to control the flow rate of said first make-up hydrogen stream;

means for establishing a fourth signal representative of the flow rate of said first make-up hydrogen stream required to maintain a desired free hydrogen concentration in the feed to said hydrodemetallization reactor;

means for establishing a fifth signal representative of the actual flow rate of said first make-up hydrogen stream;

means for comparing said fourth signal and said fifth signal and for establishing a sixth signal which is reponsive to the difference between said fourth signal and said fifth signal and scaling said sixth signal so as to be representative of the position of said control valve required to maintain the actual concentration of free hydrogen in the feed provided to said hydrodemetallization reactor substantially equal to a desired concentration; and means for manipulating said control valve in response to said sixth signal.

8. Apparatus in accordance with claim 7 wherein said means for establishing said fourth signal comprises:

means for establishing a seventh signal representative of the actual concentration of free hydrogen in the feed provided to said hydrodemetallization reactor;

means for establishing an eighth signal representative of the desired concentration of free hydrogen in the feed provided to said hydrodemetallization reactor; and means for comparing said seventh signal and said eighth signal and for establishing said fourth signal which is responsive to the difference between said seventh signal and said eighth signal and scaling said fourth signal so as to be representative of the flow rate of said first make-up hydrogen stream required to maintain the actual concentration of free hydrogen in the feed provided to said hydrodemetallization reactor substantially equal to the desired concentration represented by said eighth signal.

9. Apparatus in accordance with claim 6 additionally comprising:

means for combining a second make-up hydrogen stream with the effluent withdrawn from said hydrodemetallization reactor before said quench hydrogen stream is combined with the effluent withdrawn from said hydrodemetallization reactor; and means for manipulating the flow rate of said second make-up hydrogen stream so as to maintain a desired concentration of free hydrogen in the feed provided to said hydrodesulfurization reactor.

10. Apparatus in accordance with claim 9 wherein said means for manipulating the flow rate of said second make-up hydrogen stream comprises:

a control valve operably located so as to control the flow rate of said second make-up hydrogen stream;

means for establishing a fourth signal representative of the flow rate and said second make-up hydrogen stream required to maintain a desired concentration of free hydrogen in the feed provided to said hydrodesulfurization reactor;

means for establishing a fifth signal representative of the actual flow rate of said second make-up hydrogen stream;

means for comparing said fourth signal and said fifth signal and for establishing a sixth signal which is responsive to the difference between said fourth signal and said fifth signal and scaling said sixth signal so as to be representative of the position of said control valve required to maintain the actual flow rate of said second make-up hydrogen stream substantially equal to the desired flow rate represented by said fourth signal; and means for manipulating said control valve in response to said sixth signal.

11. Apparatus in accordance with claim 10 wherein said means for establishing said fourth signal comprises:

means for establishing a seventh signal which is representative of the actual concentration of free hydrogen in the feed provided to said hydrodesulfurization reactor;

means for establishing an eighth signal which is representative of the desired concentration of free hydrogen in the feed provided to said hydrodesulfurization reactor; and means for comparing said seventh signal and said eighth signal and for establishing said fourth signal which is responsive to the difference between said seventh signal and said eighth signal and scaling said fourth signal so as to be representative of the flow rate of said second make-up hydrogen stream required to maintain the actual concentration of free hydrogen in the feed provided to said hydrodesulfurization reactor substantially equal to the desired concentration represented by said eighth signal.

12. Apparatus in accordance with claim 9 additionally comprising:

means for combining a coke-reducing hydrogen stream with said hydrocarbon-containing feed stream before said hydrocarbon-containing feed stream is passed through said furnace; and means for manipulating the flow rate of said coke-reducing hydrogen stream so as to maintain a desired reduction of coke in said furnace.

13. Apparatus in accordance with claim 12 wherein said means for manipulating the flow rate of said coke-reducing hydrogen stream comprises:

a control valve operably located so as to control the flow rate of said coke-reducing hydrogen stream;

means for establishing a fourth signal representative of the desired flow rate of said coke-reducing hydrogen stream;

means for establishing a fifth signal representative of the actual flow rate of said coke-reducing hydrogen stream;

means for comparing said fourth signal and said fifth signal and for establishing a sixth signal which is responsive to the difference between said fourth signal and said fifth signal and scaling said sixth signal so as to be representative of the position of said control valve required to maintain the actual flow rate of said coke-reducing hydrogen stream substantially equal to the desired flow rate represented by said fourth signal; and means for manipulating said control valve in response to said sixth signal.

14. Apparatus in accordance with claim 13 wherein said means for establishing said fourth signal comprises:

means for establishing a seventh signal representative of the actual concentration of free hydrogen in said hydrocarbon-containing feed stream before said hydrocarbon-containing feed stream is passed through said furnace;

means for establishing an eighth signal representative of the desired concentration of free hydrogen in said hydrocarbon-containing feed stream before said hydrocarbon-containing feed stream is passed through said furnace so as to reduce the formation of coke in said furnace; and means for comparing said seventh signal and said eighth signal and for establishing said fourth signal which is responsive to the difference between said seventh signal and said eighth signal and scaling said fourth signal so as to be representative of the flow rate of said coke-reducing hydrogen stream required to maintain the actual concentration of free hydrogen in said hydrocarbon-containing feed stream before said hydrocarbon-containing feed stream is passed through said furance substantially equal to the desired concentration represented by said eighth signal.

15. A method comprising the steps of:

providing a hydrocarbon containing feed stream which also contains metals, sulfur and free hydrogen to a hydrodemetallization reactor to therein remove at least a portion of said metals from said hydrocarbon containing feed stream;

withdrawing the reaction fluid from said hydrodemetallization reactor;

combining a quench hydrogen stream with the effluent withdrawn from said hydrodemetallization reactor;

providing the effluent withdrawn from said hydrodemetallization reactor combined with said quench hydrogen stream as a feed to a hydrodesulfurization reactor to therein remove at least a portion of said sulfur from said hydrocarbon containing feed stream; and manipulating the flow rate of said quench hydrogen stream so as to manipulate the rate at which said quench hydrogen stream is combined with the effluent withdrawn from said hydrodemetallization reactor to thereby maintain a desired temperature for the feed provided to said hydrodesulfurization reactor.

16. A method in accordance with claim 15 wherein said step of manipulating the flow rate of said quench hydrogen stream comprises:

establishing a first signal representative of the actual temperature of the feed provided to said hydrodesulfurization reactor;

establishing a second signal representative of the desired temperature of the feed provided to said hydrodesulfurization reactor;

comparing said first signal and said second signal and establishing a third signal which is responsive to the difference between said first signal and said second signal, wherein said third signal is scaled so as to be representative of the flow rate of said quench hydrogen required to maintain the actual temperature of the feed provided to said hydrodesulfurization reactor substantially equal to the desired temperature represented by said second signal; and manipulating the flow rate of said quench hydrogen stream in response to said third signal.

17. A method in accordance with claim 16 wherein said step of manipulating the flow rate of said quench hydrogen stream in response to said third signal comprises:

establishing a fourth signal representative of the actual flow rate of said quench hydrogen stream;

comparing said third signal and said fourth signal and establishing a fifth signal which is responsive to the difference between said third signal and said fourth signal, wherein said fifth signal is scaled so as to be representative of the position of a control valve, operably located so as to control the flow rate of said quench hydrogen stream, required to maintain the actual flow rate of said quench hydrogen stream substantially equal to the desired flow rate represented by said third signal; and manipulating said control valve in response to said fifth signal.

18. A method in accordance with claim 15 additionally comprising the steps of:

passing said hydrocarbon-containing feed stream through a furnace having a burner before said hydrocarbon-containing feed stream is provided to said hydrodemetallization reactor;

providing fuel to said burner, wherein the combustion of said fuel supplies heat to said hydrocarbon-containing feed stream flowing through said furnace; and manipulating the flow of fuel to said burner so as to maintain a desired temperature for the feed provided to said hydrodemetallization reactor.

19. A method in accordance with claim 18 wherein said step of manipulating the flow of fuel to said burner comprises:

establishing a first signal representative of the actual temperature of the feed supplied to said hydrodemetallization reactor;

establishing a second signal representative of the desired temperature of the feed supplied to said hydrodemetallization reactor;

comparing said first signal and said second signal and establishing a third signal which is responsive to the difference between said first signal and said second signal, wherein said third signal is representative of the heat per unit time which must be provided to said furnace by the combustion of said fuel in order to maintain the actual temperature of the feed provided by said hydrodemetallization reactor substantially equal to the desired temperature represented by said second signal; and manipulating the flow of fuel to said burner in response to said third signal.

20. A method in accordance with claim 19 wherein said step of manipulating the flow of said fuel to said burner in response to said third signal comprises:

establishing a fourth signal which is representative of the amount of said fuel which must be combusted in order to supply 1 BTU of heat to said furnace;

multiplying said third signal and said fourth signal to establish a fifth signal which is representative of the flow rate of said fuel required to supply the heat represented by said third signal to said furnace;

establishing a sixth signal representative of the actual flow rate of said fuel;

comparing said fifth signal and said sixth signal and establishing a seventh signal which is responsive to the difference between said fifth signal and said sixth signal, wherein said seventh signal is scaled so as to be representative of the position of a control valve, operably located so as to control the flow rate of said fuel, required to maintain the actual flow rate of said fuel substantially equal to the desired flow rate represented by said fifth signal; and manipulating said control valve in response to said seventh signal.

21. A method in accordance with claim 18 additionally comprising the steps of:

combining a first make-up hydrogen stream with the feed stream provided to said hydrodemetallization reactor after said feed stream is passed through said furnace; and manipulating the flow rate of said first make-up hydrogen stream so as to maintain a desired free hydrogen concentration in the feed provided to said hydrodemetallization reactor.

22. A method in accordance with claim 21 wherein said step of manipulating the flow rate of said first make-up hydrogen stream comprises:

establishing a first signal representative of the flow rate of said first make-up hydrogen stream required to maintain the desired free hydrogen concentration in the feed to said hydrodemetallization reactor;

establishing a second signal representative of the actual flow rate of said first make-up hydrogen stream;

comparing said first signal and said second signal and establishing a third signal which is responsive to the difference between said first signal and said second signal, wherein said third signal is scaled so as to be representative of the position of a control valve, operably located so as to control the flow rate of said first make-up hydrogen stream, required to maintain the actual concentration of free hydrogen in the feed provided to said hydrodemetallization reactor substantially equal to a desired concentration; and manipulating said control valve in response to said third signal.

23. A method in accordance with claim 22 wherein said step of establishing said first signal comprises:

establishing a fourth signal representative of the actual concentration of free hydrogen in the feed provided to said hydrodemetallization reactor;

establishing a fifth signal representative of the desired concentration of free hydrogen in the feed provided to said hydrodemetallization reactor; and comparing said fourth signal and said fifth signal and establishing said first signal which is responsive to the difference between said fourth signal and said fifth signal, wherein said first signal is scaled so as to be representative of the flow rate of said first make-up hydrogen stream required to maintain the actual concentration of free hydrogen in the feed provided to said hydrodemetallization reactor substantially equal to the desired concentration represented by said fifth signal.

24. A method in accordance with claim 21 additionally comprising the steps of:

combining a second make-up hydrogen stream with the effluent withdrawn from said hydrodemetallization reactor before said quench hydrogen stream is combined with the effluent withdrawn from said hydrodemetallization reactor; and manipulating the flow rate of said second make-up hydrogen stream so as to maintain the desired concentration of free hydrogen in the feed provided to said hydrodesulfurization reactor.

25. A method in accordance with claim 24 wherein said step of manipulating the flow rate of said second make-up hydrogen stream comprises:

establishing a first signal representative of the flow rate of said second make-up hydrogen stream required to maintain the desired concentration of free hydrogen in the feed provided to said hydrodesulfurization reactor;

establishing a second signal representative of the actual flow rate of said second make-up hydrogen stream;

comparing said first signal and said second signal and establishing a third signal which is responsive to the difference between said first signal and said second signal, wherein said third signal is scaled so as to be representative of the position of a control valve, operably located so as to control the flow rate of said second make-up hydrogen stream, required to maintain the actual flow rate of said second make-up hydrogen stream substantially equal to the desired flow rate represented by said first signal; and manipulating said control valve in response to said third signal.

26. A method in accordance with claim 25 wherein said step of establishing said first signal comprises:

establishing a fourth signal which is representative of the actual concentration of free hydrogen in the feed provided to said hydrodesulfurization reactor;

establishing a fifth signal which is representative of the desired concentration of free hydrogen in the feed provided to said hydrodesulfurization reactor; and comparing said fourth signal and said fifth signal and establishing said first signal which is responsive to the difference between said fourth signal and said fifth signal, wherein said first signal is scaled so as to be representative of the flow rate of said second make-up hydrogen stream required to maintain the actual concentration of free hydrogen in the feed provided to said hydrodesulfurization reactor substantially equal to the desired concentration represented by said fifth signal.

27. A method in accordance with claim 24 additionally comprising the steps of:

combining a coke-reducing hydrogen stream with said hydrocarbon-containing feed stream before said hydrocarbon-containing feed stream is passed through said furnace; and manipulating the flow rate of said coke-reducing hydrogen stream so as to maintain a desired reduction of coke in said furnace.

28. A method in accordance with claim 27 wherein said step of manipulating the flow rate of said coke-reducing hydrogen stream comprises:

establishing a first signal representative of the desired flow rate of said coke-reducing hydrogen stream;

establishing a second signal representative of the actual flow rate of said coke-reducing hydrogen stream;

comparing said first signal and said second signal and establishing a third signal which is responsive to the difference between said first signal and said second signal, wherein said third signal is scaled so as to be representative of the position of a control valve, operably located so as to control the flow rate of said coke-reducing hydrogen stream, required to maintain the actual flow rate of said coke-reducing hydrogen stream substantially equal to the desired flow rate represented by said first signal; and manipulating said control valve in response to said third signal.

29. A method in accordance with claim 28 wherein said step of establishing said first signal comprises:

establishing a fourth signal representative of the actual concentration of free hydrogen in said hydrocarbon-containing feed stream before said hydrocarbon-containing feed stream is passed through said furnace;

establishing a fifth signal representative of the desired concentration of free hydrogen in said hydrocarbon-containing feed stream before said hydrocarbon-containing feed stream is passed through said furnace so as to reduce the formation of coke in said furnace; and comparing said fourth signal and said fifth signal and establishing said first signal which is responsive to the difference between said fourth signal and said fifth signal, wherein said first signal is scaled so as to be representative of the flow rate of said coke-reducing hydrogen stream required to maintain the actual concentration of free hydrogen in said hydrocarbon-containing feed stream before said hydrocarbon-containing feed stream is passed through said furance substantially equal to the desired concentration represented by said fifth signal.

* * * * *